US010569565B2

(12) United States Patent
Yoshikawa et al.

(10) Patent No.: US 10,569,565 B2
(45) Date of Patent: Feb. 25, 2020

(54) LIQUID EJECTION HEAD AND LIQUID EJECTION APPARATUS

(71) Applicant: CANON KABUSHIKI KAISHA, Tokyo (JP)

(72) Inventors: Shimpei Yoshikawa, Yokohama (JP); Ryo Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/210,496

(22) Filed: Dec. 5, 2018

(65) Prior Publication Data

US 2019/0176477 A1 Jun. 13, 2019

(30) Foreign Application Priority Data

Dec. 7, 2017 (JP) ..... 2017-235236

(51) Int. Cl.
*B41J 2/19* (2006.01)
*B41J 2/175* (2006.01)

(52) U.S. Cl.
CPC ..... *B41J 2/19* (2013.01); *B41J 2/17506* (2013.01); *B41J 2/17513* (2013.01); *B41J 2/17596* (2013.01); *B41J 2202/07* (2013.01)

(58) Field of Classification Search
CPC . B41J 2/19; B41J 2/175; B41J 2/17506; B41J 2/17513; B41J 2/17596; B41J 2202/07
See application file for complete search history.

(56) References Cited

U.S. PATENT DOCUMENTS

| | | | | |
|---|---|---|---|---|
| 6,712,460 | B2 * | 3/2004 | Ohashi | B41J 2/17513 347/86 |
| 7,413,295 | B2 | 8/2008 | Takata et al. | |
| 7,540,598 | B2 * | 6/2009 | Hori | B41J 2/17513 347/86 |
| 9,718,274 | B2 | 8/2017 | Inada et al. | |
| 9,770,911 | B2 | 9/2017 | Inada et al. | |
| 2007/0109362 | A1 * | 5/2007 | Hori | B41J 2/17513 347/65 |

FOREIGN PATENT DOCUMENTS

JP 2005-271546 A 10/2005

* cited by examiner

*Primary Examiner* — Anh T Vo
(74) *Attorney, Agent, or Firm* — Venable LLP

(57) ABSTRACT

A liquid ejection head including a supplying path supplying a liquid ejected from an ejection port includes a vent path branching from the supplying path to extend along a horizontal direction, the vent path enabling collection of bubbles mixed into the liquid. An inner surface of the vent path extending along the horizontal direction includes an area formed thereon and having a greater contact angle to the liquid than that of an inner surface of the supplying path.

15 Claims, 7 Drawing Sheets

LIQUID EJECTION HEAD AND LIQUID EJECTION APPARATUS

BACKGROUND OF THE INVENTION

Field of the Invention

The present invention relates to a liquid ejection head capable of ejecting a liquid such as ink and a liquid ejection apparatus including the liquid ejection head.

Description of the Related Art

Japanese Patent Application Laid-Open No. 2005-271546 discloses a technique for suppressing a fluctuation in pressure in an ink supplying path resulting from reciprocating movement of a recording head via a carriage and removing bubbles mixed into ink in the ink supplying path. In the technique disclosed in Japanese Patent Application Laid-Open No. 2005-271546, a buffer chamber (ink storage chamber) is provided immediately above a connection port connected to an ink supplying port of the recording head, and is capable of storing bubbles. A damper acting chamber is provided in the ink supplying path on an upstream side of the buffer chamber.

SUMMARY OF THE INVENTION

A liquid ejection head according to an aspect of the present invention includes a supplying path supplying a liquid to be ejected from an ejection port and includes a vent path branching from the supplying path to extend along a horizontal direction, the vent path enabling collection of bubbles mixed into the liquid. An inner surface of the vent path extending along the horizontal direction includes a first area formed thereon and having a larger contact angle to the liquid than an inner surface of the supplying path.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In the buffer chamber as described in Japanese Patent Application Laid-Open No. 2005-271546, ink is stored to allow bubbles mixed into the ink to be removed utilizing buoyancy of the bubbles. Thus, the buffer chamber needs an area for collection of the bubbles provided on a vertically upper side of an area where the ink is stored. This limits miniaturization of the ink supplying path in the vertical direction, hindering miniaturization of a recording head in the vertical direction.

In view of the above-described problem, an object of the present invention is to provide a liquid ejection head and liquid ejection apparatus capable of being miniaturized in the vertical direction.

Hereinafter, examples of the liquid ejection head and the liquid ejection apparatus according to the present invention will be described in detail with reference to the attached drawings. Components described below in the exemplary embodiments are illustrative only and are not intended to limit the scope of the present invention only to the components.

First Exemplary Embodiment

Figure 1:
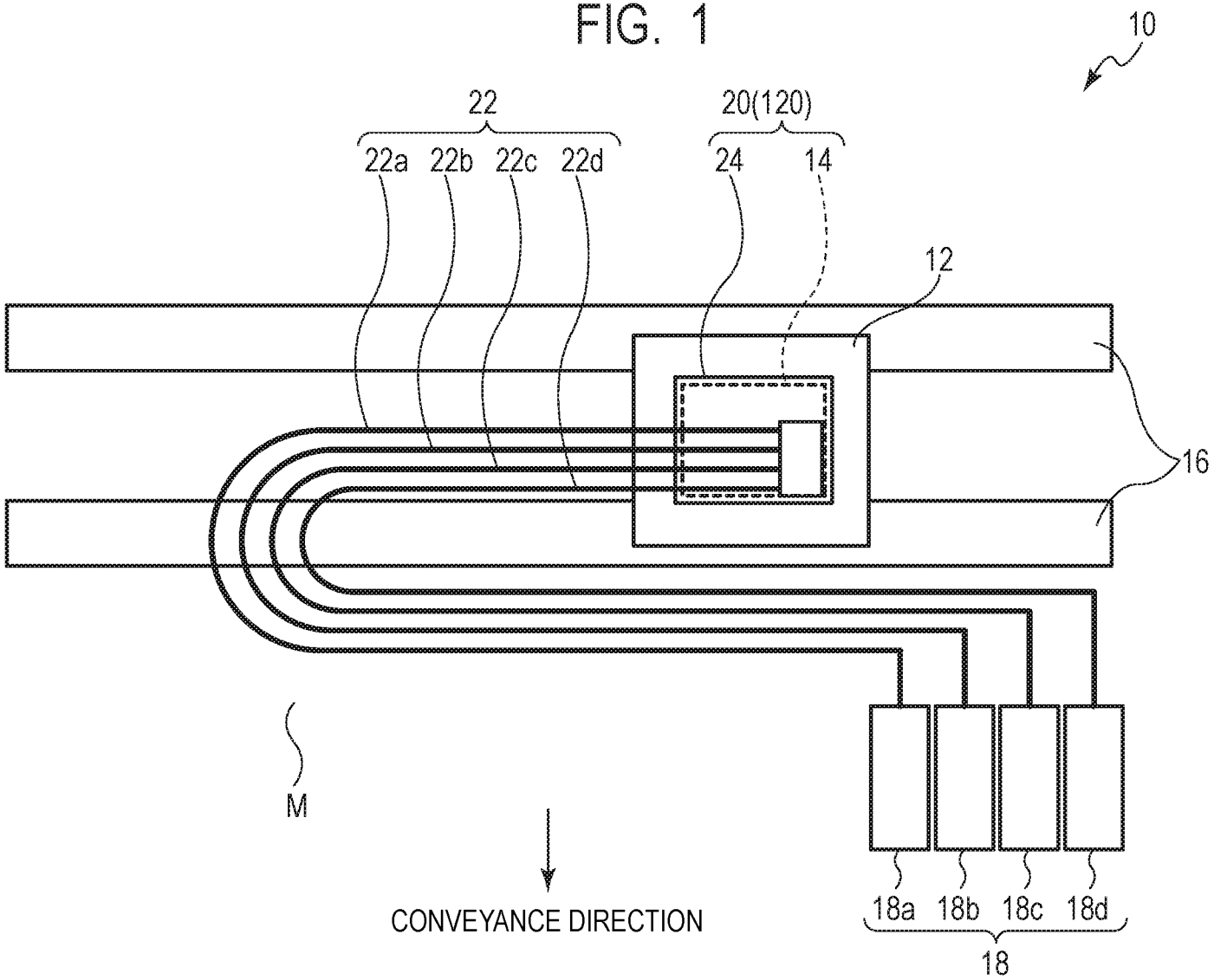
FIG. 1 is a schematic configuration diagram of a liquid ejection apparatus including a liquid ejection head according to the present invention.

First, with reference to FIGS. 1 to 4C, a first exemplary embodiment of the liquid ejection head according to the present invention will be described. FIG. 1 is a schematic configuration diagram of the liquid ejection apparatus including the liquid ejection head according to the present invention. The liquid ejection apparatus including the liquid ejection head will be described taking, as an example, a printing apparatus including a recording head ejecting ink.

A printing apparatus 10 (liquid ejection apparatus) illustrated in FIG. 1 is what is called a serial-scan ink jet printing apparatus executing printing while a recording head ejecting ink (liquid) moves (scans) in a direction crossing a conveyance direction of a print medium M (in the exemplary embodiment, the direction is orthogonal to the conveyance direction). That is, the printing apparatus 10 includes a recording head unit 20 moving by way of a carriage 12 in the direction crossing the conveyance direction with respect to the print medium M conveyed in the conveyance direction. The recording head unit 20 includes a recording head 14 ejecting ink onto the print medium M and an ink supplying unit 24 supplying ink to the recording head 14. The recording head unit 20 is provided in the carriage 12 such that an ejection port surface (not illustrated in the drawings) in the recording head 14, the ejection port surface including ejection ports that eject ink formed therein, lies opposite to the print medium M conveyed. In this case, the ejection port surface is provided to keep a constant distance from the print medium M in the vertical direction, which is orthogonal to the conveyance direction of the print medium M and a moving direction (scanning direction) of the recording head unit 20.

The carriage 12 is movably arranged on a pair of guiderails 16 extending in the direction crossing the conveyance direction of the print medium M. A motor (not illustrated in the drawings) is connected to the carriage 12 to drive the carriage 12 such that the carriage 12 reciprocates on the guiderails 16. While moving by way of the carriage 12 in the direction crossing the conveyance direction (scanning direction), the recording head unit 20 ejects ink onto the print medium M conveyed in the conveyance direction to print a predetermined image on the print medium M.

The recording head unit 20 (liquid ejection head) connects to a tube 22 (tube unit) enabling supplying of ink stored in an ink tank 18 (storage unit). Inks in respective colors are independently stored in the ink tank 18. For example, the ink tank 18 includes an ink tank 18*a* storing a cyan ink, an ink tank 18*b* storing a magenta ink, an ink tank 18*c* storing a yellow ink, and an ink tank 18*d* storing a black ink. The inks stored in the ink tank 18 are not limited to the four colors but may be one to three colors or in five or more colors.

The ink tank 18 is arranged in the printing apparatus 10, and each of the ink tanks 18*a*, 18*b*, 18*c*, and 18*d* is provided with an injection port (not illustrated in the drawings) for external injection of ink Therefore, a user refills any of the ink tanks 18*a*, 18*b*, 18*c*, and 18*d* with the corresponding ink through the injection port as needed. The ink tank 18 is arranged in the printing apparatus 10 and may thus be increased in size to increase an ink storage amount. When the ink tank 18 is refilled with ink, the ink injected through the injection port may, for example, entrain air, increasing the likelihood that bubbles are mixed into the ink. The ink tank 18 may be configured as a cartridge-type ink tank externally inserted into the printing apparatus 10. Furthermore, instead of the ink tank 18, an ink cartridge may be mounted directly on the carriage 12.

A tube 22 includes a first end connected to the ink tank 18 and a second end connected to an inflow port 32 (described below) of an ink supplying unit 24. Specifically, the tube 22 includes tubes 22*a*, 22*b*, 22*c*, and 22*d* respectively connected to the ink tanks 18*a*, 18*b*, 18*c*, and 18*d*. Furthermore, the tube 22 is formed of, for example, a flexible material such as rubber.

In the recording head unit 20, the ink supplying unit 24 includes four channels 30 independently supplying, to the recording head 14, the inks fed from the ink tanks 18*a*, 18*b*, 18*c*, and 18*d* via the tubes 22*a*, 22*b*, 22*c*, and 22*d*. Furthermore, the recording head 14 includes a plurality of ejection ports for the respective inks formed in the ejection port surface. The recording head 14 is configured to be, for example, driven by ejection energy generation elements such as piezoelectric elements to eject, through the ejection ports, the ink fed from the ink supplying unit 24.

Figure 2:
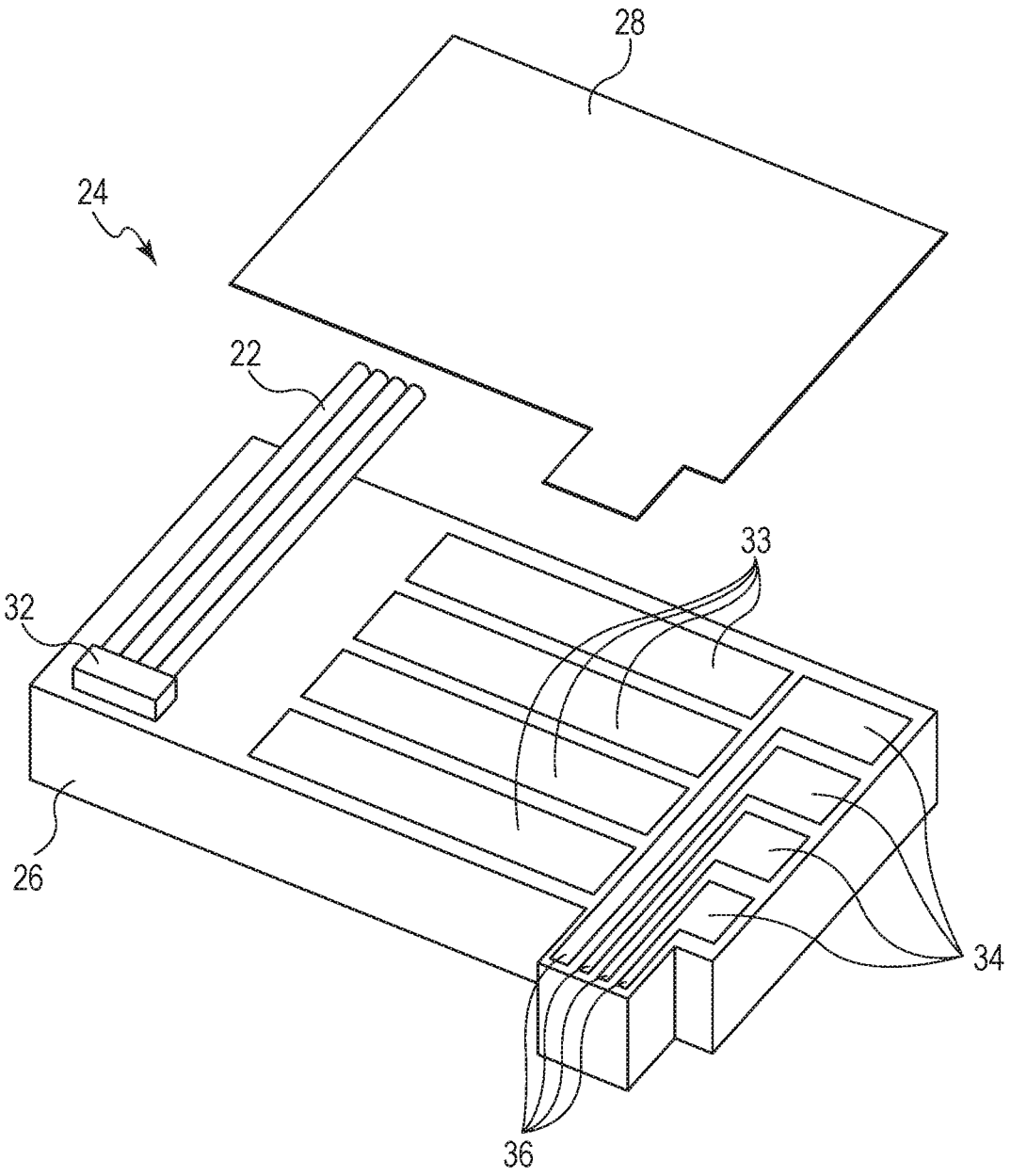
FIG. 2 is a schematic configuration diagram illustrating that a part of an ink supplying unit has been disassembled.
Figure 3:
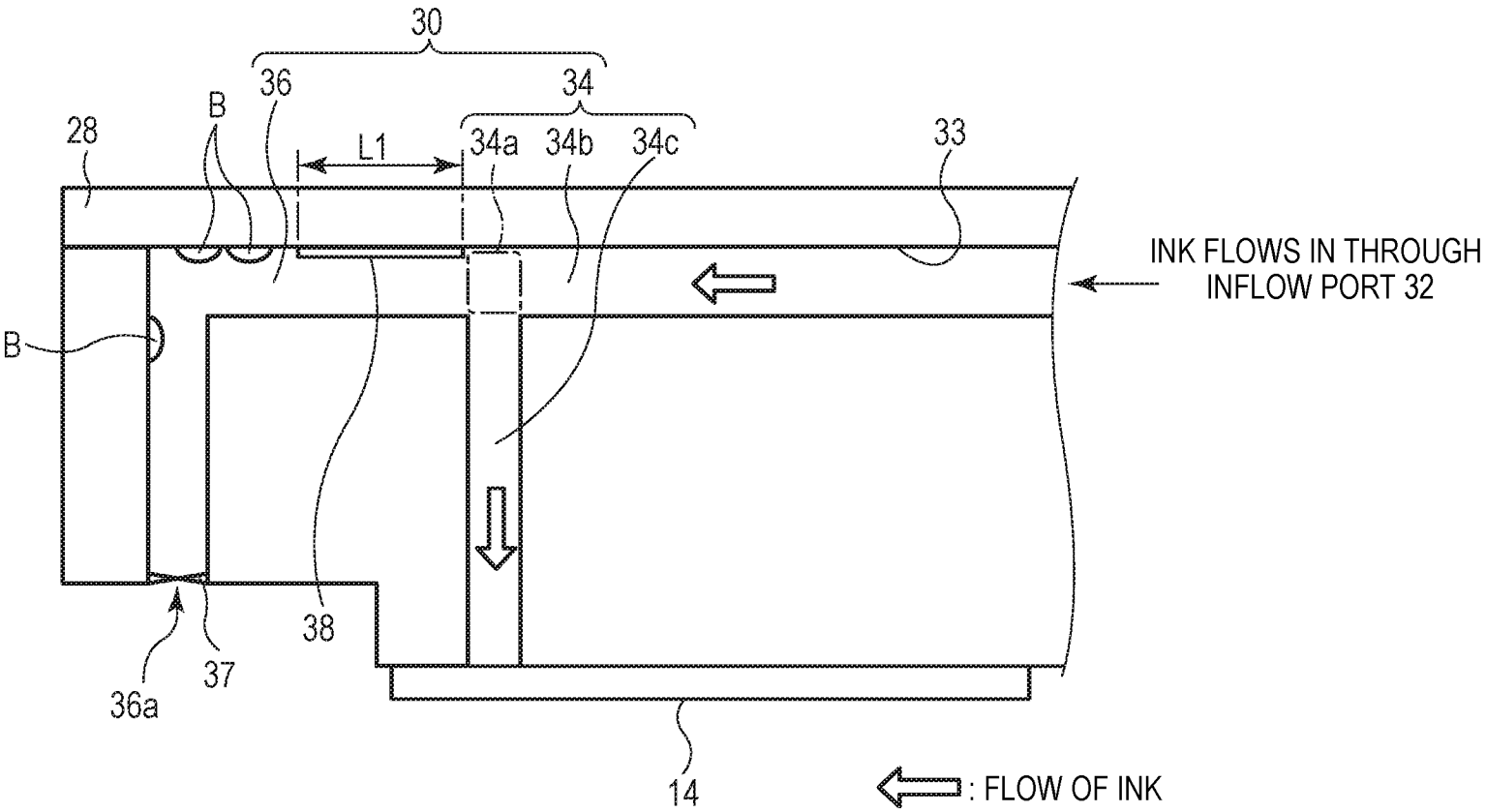
FIG. 3 is a schematic diagram schematically illustrating a channel in the liquid ejection head according to a first exemplary embodiment of the present invention.

Now, a configuration of the ink supplying unit 24 will be described with reference to FIG. 2 and FIG. 3. FIG. 2 is an exploded view illustrating certain components in the ink supplying unit 24 in a disassembled state. FIG. 3 is a diagram schematically illustrating a configuration of one channel 30 of the ink supplying unit 24. Therefore, the ink supplying unit 24 includes, for each of the inks, the channel 30 illustrated in FIG. 3.

The ink supplying unit 24 is configured to include a flexible film member 28 welded to a vertically upper surface of a resin member 26 (the "vertically upper surface" is hereinafter referred to as the "upper surface" as appropriate) (see FIG. 2). The resin member 26 includes the channel 30 formed therein to guide, to the recording head 14, the ink fed via the tube 22 and to enable removal of bubbles B mixed into the ink (see FIG. 3). The inflow port 32 is formed in the channel 30 and connected to the tube 22 such that the ink flows into the channel 30 through the tube 22 via the inflow port 32. That is, the inflow port 32 of the ink supplying unit 24 connects to the tubes 22*a*, 22*b*, 22*c*, and 22*d*, and each of the inks fed via the tubes 22 flows into the channel 30 through the inflow port 32. A part of an upper surface of the channel 30 is formed of the film member 28.

As illustrated in FIG. 3, the channel 30 includes a supplying path 34 for supplying, to the recording head 14, the ink having flowed in through the inflow port 32 and a vent path 36 branching from the middle of the supplying path 34 and enabling collection of the bubbles B mixed into the ink. The supplying path 34 includes a supplying path 34*b* through which the ink having flowed in through the inflow port 32 flows, for example, in a substantially horizontal direction. That is, the supplying path 34*b* extends along the horizontal direction. The supplying path 34 also includes a supplying path 34*c* formed at a branching position 34*a* where the vent path 36 branches. The ink having flowed in through the supplying path 34*b* flows, for example, substantially downward in the vertical direction through the supplying path 34*c*. The supplying path 34*c* is connected to the recording head 14. Furthermore, the vent path 36 extends from the branching position 34*a*, for example, along the extending direction of the supplying path 34*b*. That is, the vent path 36 branches from the supplying path 34*b* to extend along the horizontal direction. That is, in the present exemplary embodiment, the vent path 36, the branching position 34*a*, and the supplying path 34*b* are connected together in such a manner as to extend in a substantially horizontal direction. Upper surfaces of the vent path 36, the branching position 34*a*, and the supplying path 34*b* positioned on an upstream side of the branching position 34*a* are formed of the film member 28. In the present exemplary embodiment, the upstream side in the direction in which the ink flows through the supplying path 34 is simply referred to as the "upstream side". A downstream side in the ink flow direction is simply referred to as the "downstream side". The horizontal direction as used herein means the horizontal direction in an orientation in which the liquid ejection head is installed in the liquid ejection apparatus. The extension along the horizontal direction means extension within an inclination range of ±5 degrees with respect to the horizontal direction. Furthermore, the vertical direction as used herein means the vertical direction in the orientation in which the liquid ejection head is installed in the liquid ejection apparatus.

The supplying path 34 includes the supplying path 34*b* with the upper surface thereof formed of the film member 28 and the supplying path 34*c* extending, to the recording head 14, from the branching position 34*a* where the vent path 36 branches. That is, the supplying path 34*b* is positioned on the upstream side of the branching position 34*a* in the supplying path 34, and the supplying path 34*c* is positioned on the downstream side of the branching position 34*a* in the supplying path 34. The supplying path 34*b* is provided with a damper unit 33 formed of the film member 28 and enabling absorption of a fluctuation in pressure resulting from reciprocating movement of the carriage 12 and the like. To facilitate understanding, FIG. 3 and other figures illustrate only the position of the damper unit 33. The damper unit 33 may be formed using a well-known technique for a damper member.

In an area adjacent to the branching position 34*a*, the vent path 36 is formed on a plane identical to the upper surface of the branching position 34*a*, and the plane is, for example, a horizontal surface. That is, in the area adjacent to the branching position 34*a*, the supplying path 34*b* and the vent path 36 are formed on the identical plane on which the branching position 34*a* is formed. In other words, a partial area of the vent path 36 may extend along the extending direction of the supplying path 34*b* as illustrated in FIG. 3. Alternatively, for example, the vent path 36 may be bent on the identical plane in such a manner as to extend closer to or farther from the reader with respect to the sheet of the drawing.

Furthermore, the vent path 36 includes a vent port 36*a* formed at a lower end of an area of the vent path 36 extending vertically downward from an area of the vent path 36 formed on the identical plane on which the branching position 34*a* is formed. The vent port 36*a* is provided with a valve 37 preventing the ink filling the vent path 36 from leaking through the vent port 36*a*. The vent port 36*a* is configured to allow a suction unit (not illustrated in the drawings) provided in a recovery unit (not illustrated in the drawings) to be connected to the vent port 36*a*. The recovery unit is provided in the printing apparatus 10 to execute a process for maintaining and recovering an ink ejection state of the recording head 14. When the suction unit is connected to the vent port 36*a* at a predetermined timing, the valve 37 is opened to allow the suction unit to suck the bubbles B in the vent path 36 along with the ink.

Furthermore, an inner surface of the vent path 36 includes a first area 38 formed on the upper surface of an area of the vent path 36 adjacent to the branching position 34*a*, the first area 38 having a length L1 and low wettability to the ink That is, the first area 38 has a larger ink contact angle than the remaining area on the inner surface of the channel 30 (the inner surface of the channel 30 except for the supplying path 34 and the first area 38, that is, the inner surface of the vent path 36). For example, when the contact angle to the ink is approximately 90° in the remaining area, the contact angle to the ink is 100° or larger in the first area 38. The contact angle as used herein means a static contact angle. The length L1 of the first area may be 3 mm or more and 10 mm or less.

Surface treatment (surface coating such as deposition and etching) is applied to the above-described first area 38 to adjust the ink contact angle such that the ink contact angle is larger in the first area 38 than in the remaining area. That is, in the present exemplary embodiment, since the upper surface of the vent path 36 is formed of the film member 28, surface treatment is applied to the position corresponding to the first area 38 of the film member 28 welded to the resin member 26. In the channel 30, such a configuration causes the bubbles B having reached the branching position 34*a* to move more easily to the first area 38 with the large ink contact angle than to the supplying path 34*b* with the ink contact angle identical to that of (the upper surface of) the branching position 34*a*. Thus, in the channel 30, the bubbles B in the supplying path 34 are more likely to be drawn into the vent path 36.

In the above-described configuration, in the recording head unit 20, when the ink is ejected from the recording head 14 while the channel 30 is filled with the ink, the ink in the supplying path 34 is fed to the recording head 14, and the ink in the tube 22 is fed to the supplying path 34 via the inflow port 32. Furthermore, when the reciprocating motion of the carriage 12 in the scanning direction fluctuates pressure while the channel 30 is filled with the ink, the damper unit 33 absorbs the fluctuation in pressure. For example, in a case where the damper unit 33 includes a function to hold air, the held air and the flexible film absorb the fluctuation in pressure.

Figure 4A:
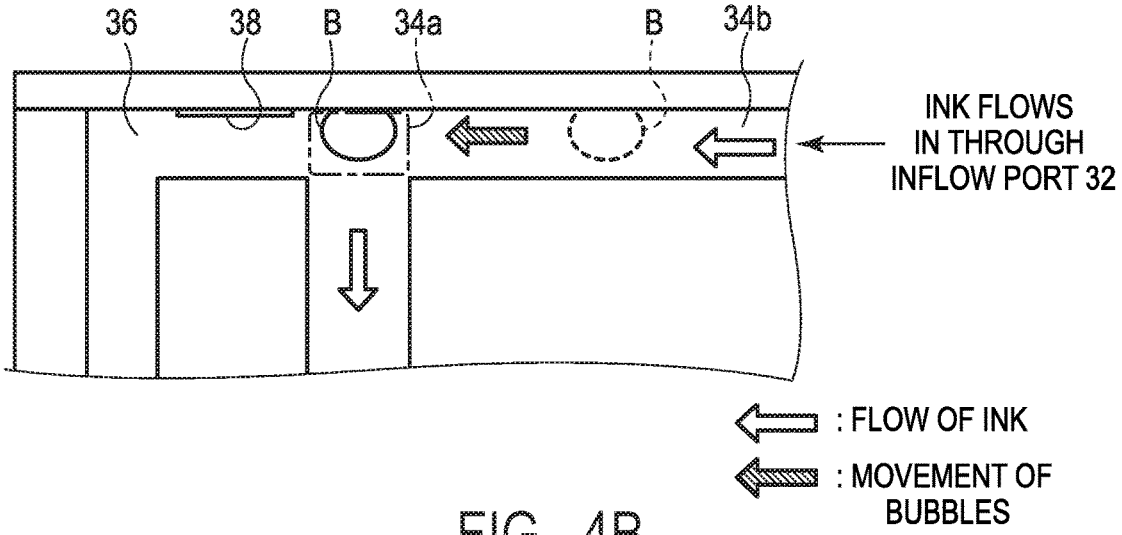
FIGS. 4A, 4B and 4C are diagrams illustrating movement of bubbles collected in a vent path in the channel in FIG. 3.
Figure 4B:
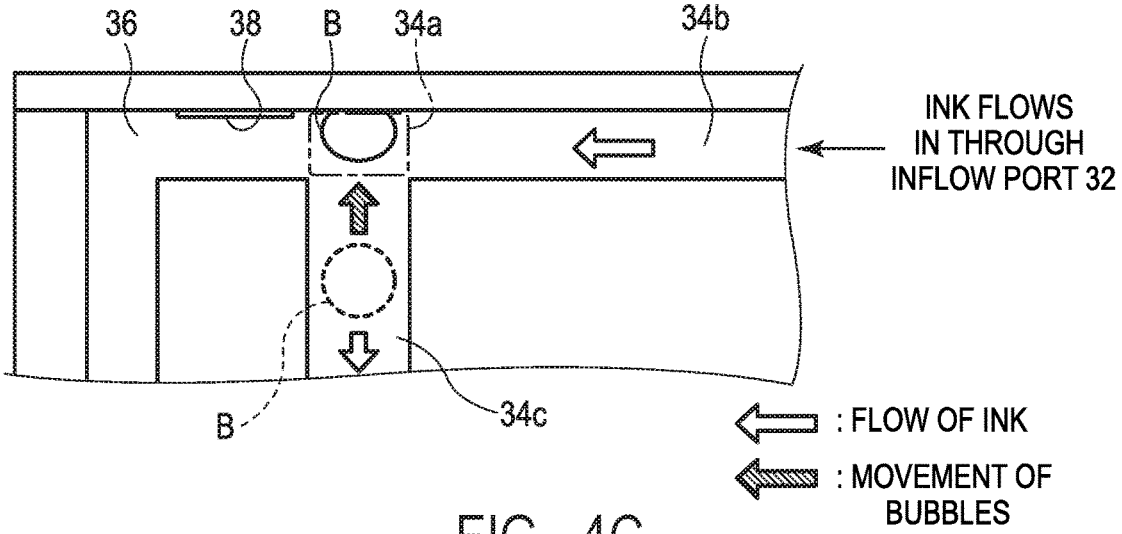
Figure 4C:
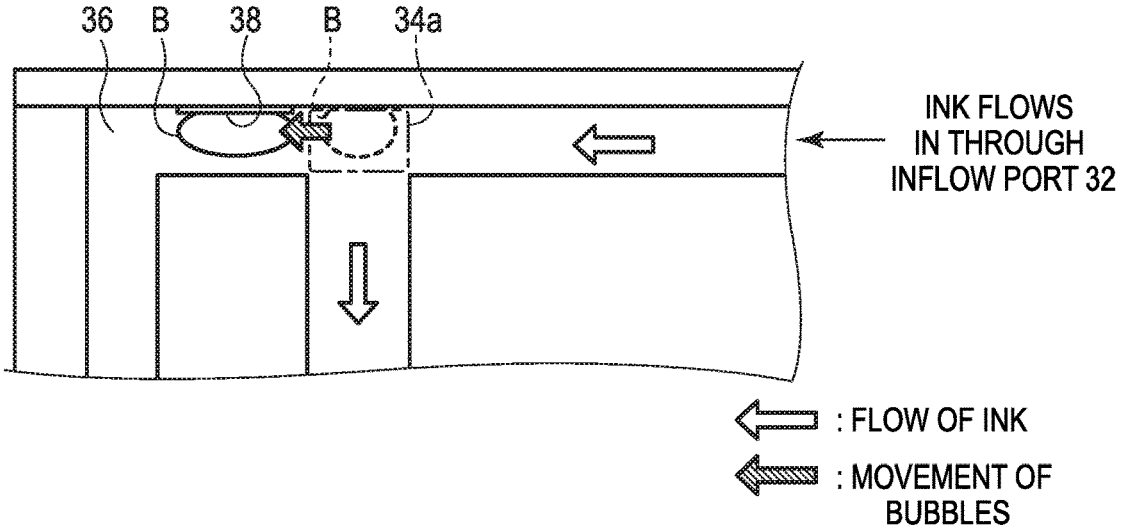

Now, with reference to FIGS. 4A to 4C, movements of the bubbles B in the channel 30 of the recording head unit 20 will be described. FIG. 4A is a diagram illustrating an example of a motion of the bubbles B in the supplying path 34*b*. FIG. 4B is a diagram illustrating an example of a motion of the bubbles B in the supplying path 34*c*. FIG. 4C is a diagram illustrating an example of a motion of the bubbles B at the branching position 34*a*.

The bubbles B mixed into the ink (for example, bubbles no longer held by the damper unit 33 or bubbles of air transmitted through the film member 28 and the tube 22) mostly flow along the upper surface of the supplying path 34*b* and reach the branching position 34*a* as illustrated in FIG. 4A. The bubbles B having reached the branching position 34*a* subsequently move to the first area 38 with the larger contact angle to the ink (lower wettability to the ink) than the branching position 34*a* and flow into the vent path 36, as illustrated in FIG. 4C. That is, the bubbles B at the branching position 34*a* are attracted to the first area 38 due to a difference in wettability (ink contact angle) between the upper surface of the branching position 34*a* and the first area 38.

Moreover, for example, bubbles flow to the supplying path 34*c* via the branching position 34*a* and bubbles are generated during printing (all of these bubbles are the bubbles B). These bubbles float in the supplying path 34 due to buoyancy of the bubbles and reach the upper surface of the branching position 34*a* as illustrated in FIG. 4B. The bubbles B subsequently move to the first area 38 with the larger contact angle to the ink than the branching position 34*a* and flow into the vent path 36, as illustrated in FIG. 4C. The bubbles B thus collected in the vent path 36 are sucked by the suction unit of the recovery unit via the vent port 36*a* at a predetermined timing and then discharged to the outside of the ink supplying unit 24.

As described above, the vent path 36 in the recording head unit 20, branching from the middle of the supplying path 34, includes the first area 38 formed on the upper surface of the vent path 36 adjacent to the branching position 34*a* and having the larger contact angle to the ink (lower wettability) than the remaining area. Consequently, the bubbles B having reached the upper surface of the branching position 34*a* move easily to the first area 38 due to the difference in ink contact angle (wettability) between the upper surface of the branching position 34*a* and the first area 38. Thus, the bubbles B at the branching position 34*a* are restrained from moving to the supplying paths 34*b* and 34*c*, whereas movement of the bubbles B to the vent path 36 is promoted.

Furthermore, in the recording head unit 20, the vent path 36 extends in the horizontal direction from the supplying path 34*b* extending in the substantially horizontal direction; the vent path 36 branches from the supplying path 34*b* at the branching position 34*a*. The bubbles mixed into the ink are collected utilizing the difference in wettability to the ink between the branching position 34*a* and the first area 38 of the vent path 36. Thus, compared to the technique in Japanese Patent Application Laid-Open No. 2005-271546, collecting bubbles utilizing buoyancy, the present exemplary embodiment enables miniaturization in the vertical direction. Moreover, the channel 30 is not configured to store ink in a relatively large space such as a buffer chamber as in the technique in Japanese Patent Application Laid-Open No. 2005-271546. Thus, compared to the technique in Japanese Patent Application Laid-Open No. 2005-271546, the recording head unit 20 is light and imposes a reduced load on the carriage 12, enabling contribution to an extended life of a moving mechanism of the carriage 12.

Second Exemplary Embodiment

Figure 5:
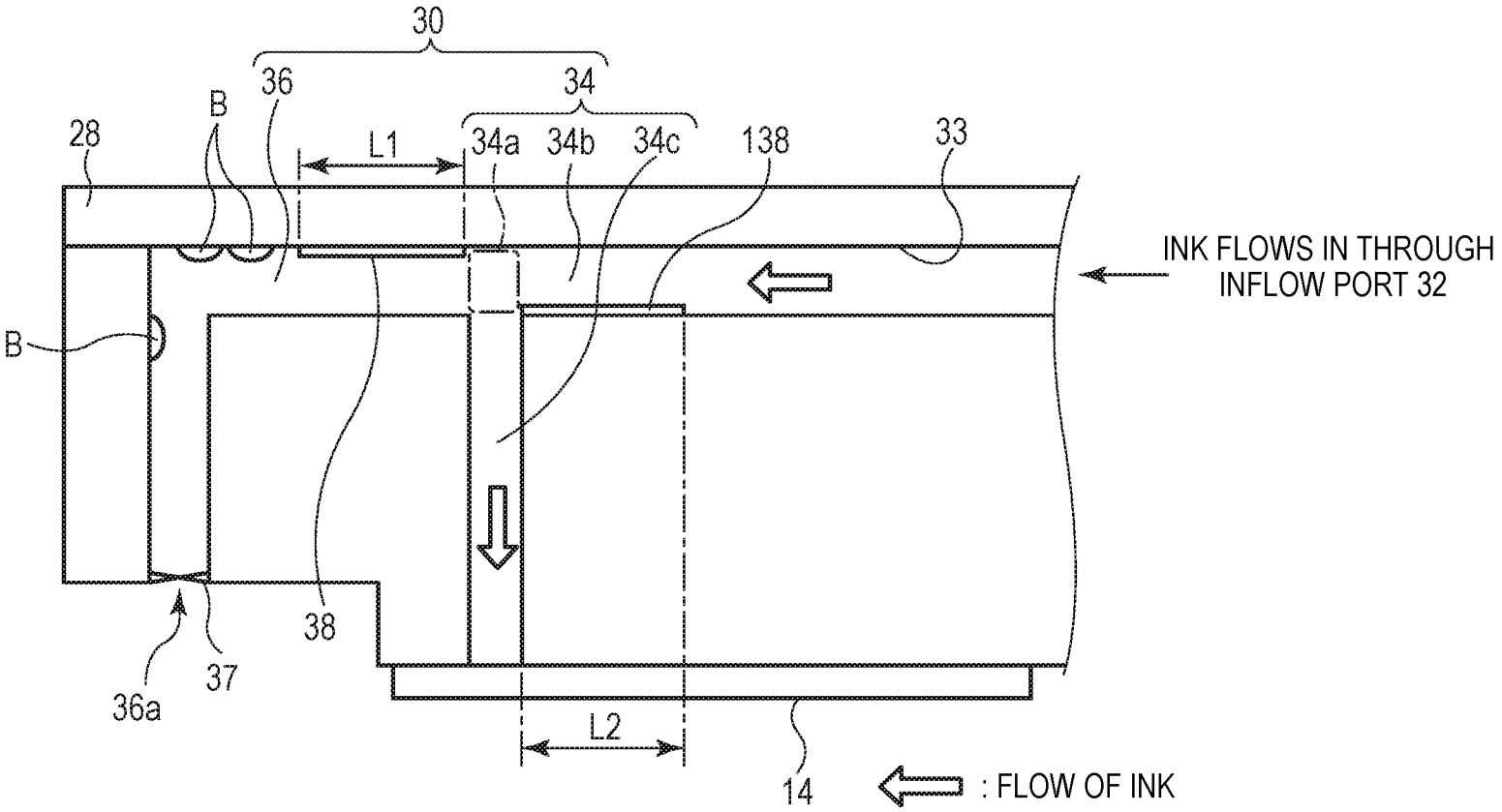
FIG. 5 is a schematic diagram schematically illustrating a channel in a liquid ejection head according to a second exemplary embodiment of the present invention.

Now, a second exemplary embodiment of the liquid ejection head according to the present invention will be described with reference to FIG. 5 and FIGS. 6A to 6C. The second exemplary embodiment will be described taking, as an example, the printing apparatus 10 executing printing using the recording head unit ejecting ink, as in the first exemplary embodiment. Furthermore, components identical or equivalent to corresponding components of the first exemplary embodiment are denoted by the identical reference numerals, and detailed description of the components is omitted as appropriate. FIG. 5 is a schematic diagram schematically illustrating a channel in the liquid ejection head according to the second exemplary embodiment of the present invention.

A recording head unit 120 according to the second exemplary embodiment is different from the above-described recording head unit 20 in the following respects. That is, in the channel 30 the recording head unit 120 includes, in addition to the first area 38, a second area 138 formed on a vertically lower part of the inner surface of the supplying path 34*b* and having a length L2 and high wettability to ink, as illustrated in FIG. 5. The second area 138 is different from the first area. The expressions "vertically lower surface" and "lower surface" are appropriately used below.

That is, in the recording head unit 120, the inner surface of the channel 30 includes the first area 38 having the lower wettability than the remaining area and the second area 138 having higher wettability than the remaining area; the first area 38 and the second area 138 are arranged across the branching position 34*a*. The second area 138 has a smaller ink contact angle than the remaining area on the inner surface of the channel 30 (the inner surface of the channel except for the branching position 34*a* and the second area 138, that is, the inner surface of the supplying path 34*b*, the supplying path 34*c*, and the vent path 36). For example, when the contact angle to the ink is approximately 90° in the area (the inner surface of the channel 30) other than the first area 38 and the second area 138, the contact angle to the ink is 100° or larger in the first area 38 and 80° or smaller in the second area 138. The length L2 of the second area may be equivalent to the length L1 of the first area and is, for example, 3 mm or more and 10 mm or less.

Surface treatment is applied to the above-described second area 138 to adjust the ink contact angle such that the ink contact angle is smaller in the second area 138 than in the remaining area. That is, in the present exemplary embodiment, surface treatment is applied to the position corresponding to the second area on the lower surface of the supplying path 34*b* in the resin member 26. In the channel 30, such a configuration causes the bubbles B floating in the supplying path 34*b* due to buoyancy of the bubbles B to move more easily to the vent path 36 side as a result of the affinity, for the ink, of the second area 138 of the supplying path 34*b* on the vertically lower side of the branching position 34*a*. Moreover, the first area 38 allows the bubbles B having reached the upper surface of the branching position 34*a* to move more easily to the first area 38 having the larger ink contact angle than (the upper surface of) the branching position 34*a*. Thus, compared to the recording head unit 20, the recording head unit 120 allows the bubbles B in the supplying path 34 of the channel 30 to be more easily drawn into the vent path 36.

Furthermore, in the channel 30, the second area 138 allows the bubbles B to float easily in the supplying path 34*b* when the bubbles B flow to the vicinity of the branching position 34*a*. Then, at the branching position 34*a*, the bubbles B reach the upper surface of the branching position 34*a*. Thus, compared to the recording head unit 20, the recording head unit 120 hinders the bubbles B from flowing into the supplying path 34*c* on the vertically lower side of the branching position 34*a*, allowing the bubbles B in the supplying path 34 to be easily drawn into the vent path 36.

Figure 6A:
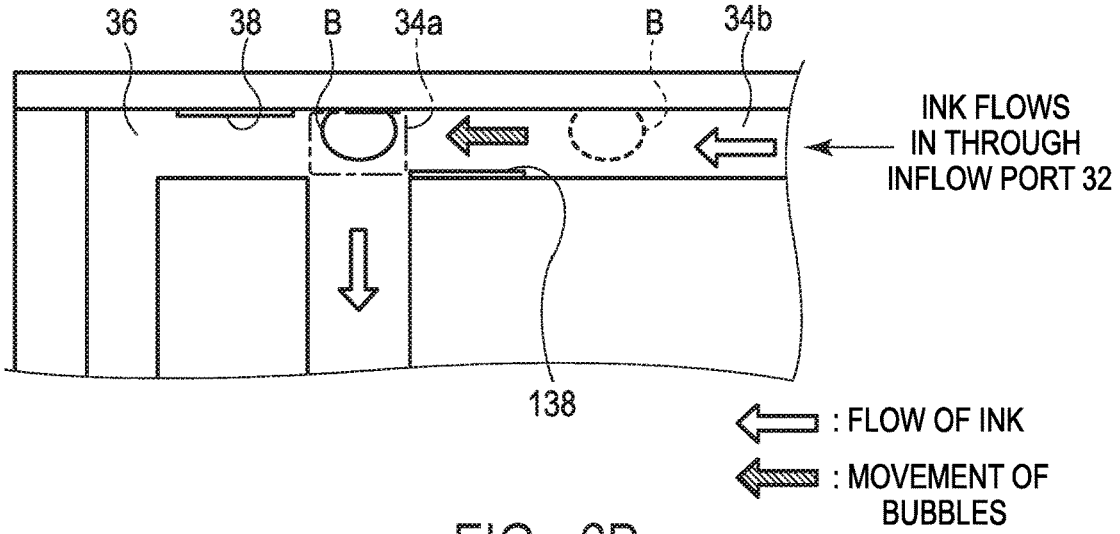
FIGS. 6A, 6B and 6C are diagrams illustrating movement of bubbles collected in a vent path in the channel in FIG. 5.
Figure 6B:
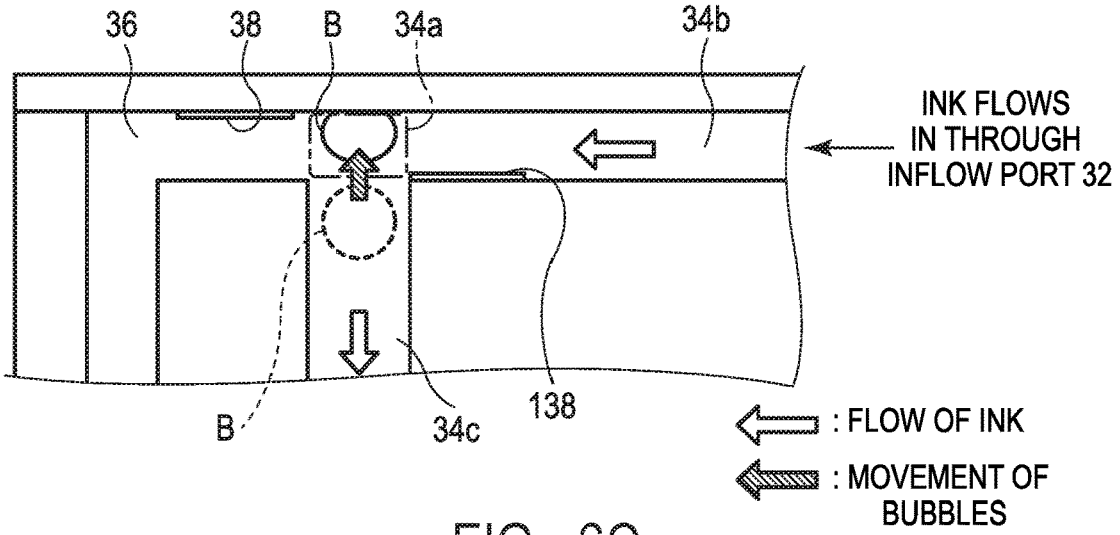
Figure 6C:
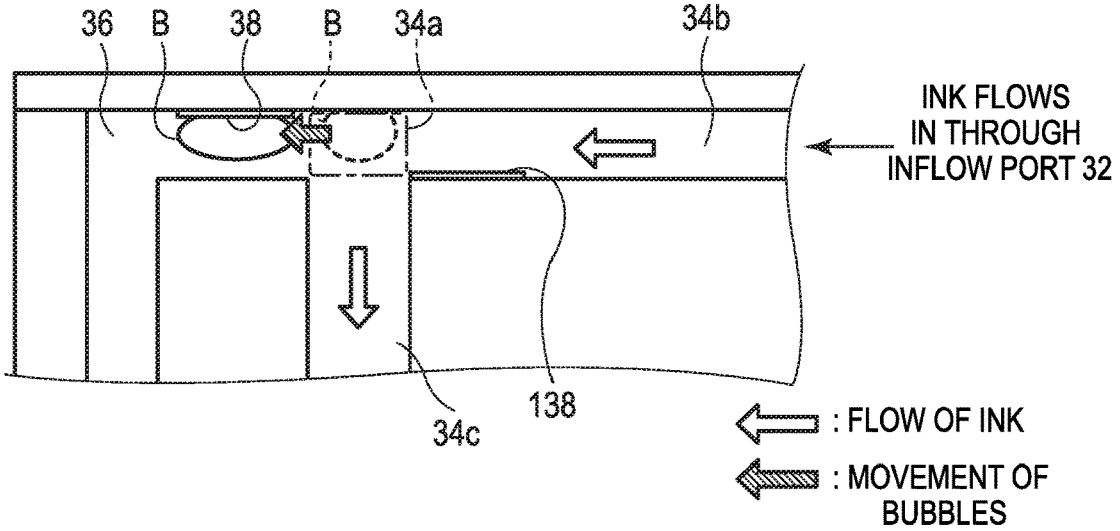

In the above configuration, a motion of the bubbles mixed into the ink while the channel 30 is filled with the ink will be described with reference to FIGS. 6A to 6C. FIG. 6A is a diagram illustrating an example of a motion of the bubbles in the supplying path 34*b*. FIG. 6B is a diagram illustrating an example of a motion of the bubbles B in the supplying path 34*c*. FIG. 6C is a diagram illustrating an example of a motion of the bubbles B at the branching position 34*a*. The recording head unit 120 absorbs a fluctuation in the pressure of the tube 22 similarly to the recording head unit 20.

The bubbles B mixed into the ink mostly flow along the upper surface of the supplying path 34*b* and reach the branching position 34*a* as illustrated in FIG. 6A. Furthermore, on the lower surface side of the supplying path 34*b*, when the bubbles B flow to the vicinity of the branching position 34*a*, the affinity of the second area 138 for the ink causes the bubbles B to float and reach the upper surface of the branching position 34*a*. The bubbles B having reached the branching position 34*a* subsequently flow into the vent path 36 as is the case with the recording head unit 20.

Furthermore, bubbles flowing into the supplying path 34*c* via the branching position 34*a* and bubbles generated during printing (all of these bubbles are the bubbles B) float from the supplying path 34*c* due to buoyancy of the bubbles and reach the branching position 34*a* as illustrated in FIG. 6B. At this time, on the vertically lower side of the branching position 34*a*, the affinity of the second area 138 for the ink causes the bubbles B to move to the vent path 36 side. Then, the bubbles B having reached the upper surface of the branching position 34*a* move to the first area 38 and flow into the vent path 36, as illustrated in FIG. 6C. The bubbles collected in the vent path 36 are sucked by the suction unit of the recovery unit via the vent port 36*a* at a predetermined timing and then discharged to the outside of the ink supplying unit 24.

As described above, the recording head unit 120 includes the first area 38 formed as in the case of the recording head unit 20. Moreover, in the recording head unit 120, the second area 138 having the smaller contact angle to the ink (higher wettability) than the remaining area is formed on the lower surface of the supplying path 34*b* adjacent to the branching position 34*a*. This promotes the movement, to the vent path 36, of the bubbles B having flowed to the branching position 34*a* as is the case with the recording head unit 20. Moreover, the affinity of the second area 138 for the ink allows the bubbles B flowing through the supplying path 34*b* toward the branching position 34*a* to move more easily to the upper surface side of the branching position 34*a*. Furthermore, the affinity of the second area 138 for the ink allows the bubbles B rising through the supplying path 34*c* to move more easily to the vent path 36 side when reaching the branching position 34*a*. Thus, compared to the recording head unit 20, the recording head unit 120 allows the bubbles B to be more reliably guided to the upper surface of the branching position 34*a*.

Furthermore, compared to the technique in Japanese Patent Application Laid-Open No. 2005-271546, the recording head unit 120, like the recording head unit 20, can be miniaturized in the vertical direction and contribute to an extended life of the movement mechanism of the carriage 12.

Other Exemplary Embodiments

The above-described exemplary embodiments may be modified as described in (1) to (7) below.

(1) The above-described exemplary embodiments involve what is called a serial-scan printing apparatus executing printing while moving the recording head unit 20 or 120 in a width direction of the print medium M. However, the present invention is not limited to this, and what is called a full-line printing apparatus may be used. That is, the recording head unit 20 or 120 may be configured such that the ejection ports for ink ejection are arranged over an area covering the maximum width of the print medium M expected to be used in a recording head unit to be used to print the print medium M.

Figure 7A:
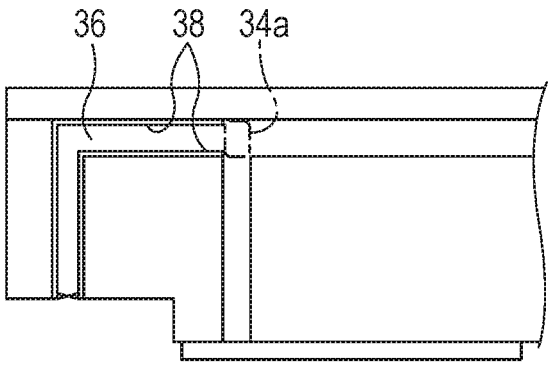
FIGS. 7A, 7B, 7C, 7D, 7E and 7F are diagrams illustrating a modified example of the liquid ejection head.
Figure 7D:
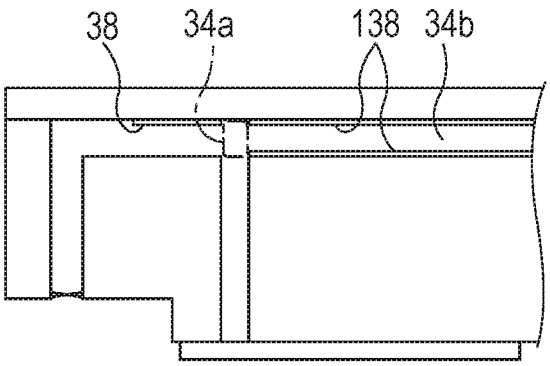
Figure 7B:
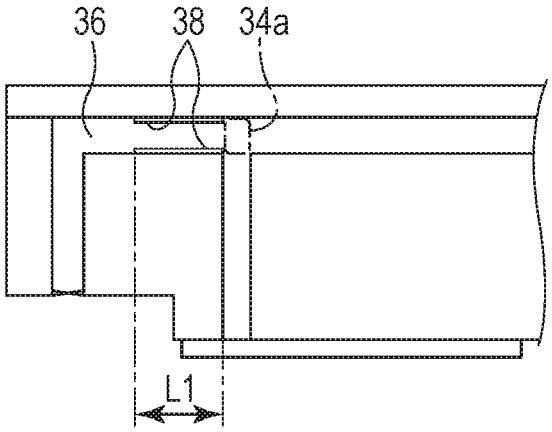
Figure 7E:
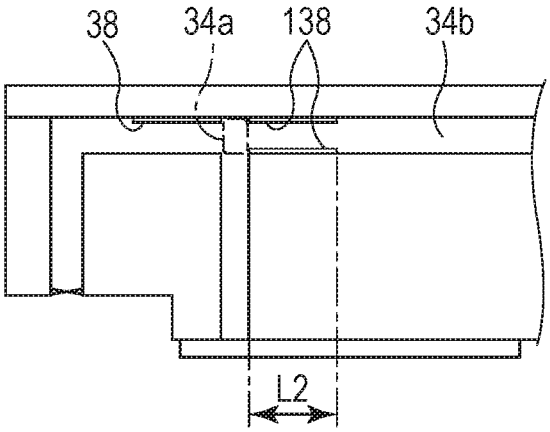
Figure 7C:
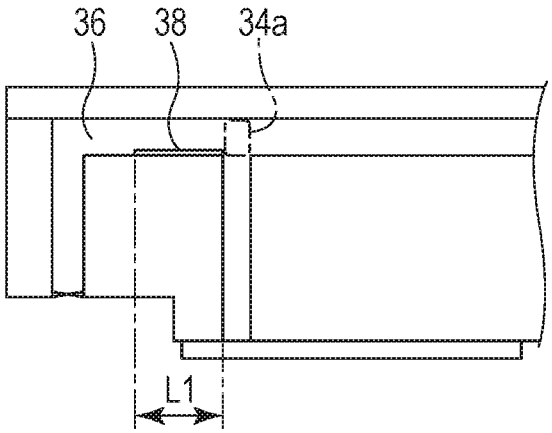

(2) In the first exemplary embodiment, the first area 38 with the larger ink contact angle than the remaining area is provided on the upper surface of the vent path 36 adjacent to the branching position 34*a*. However, the present invention is not limited to this. That is, the first area 38 may be the entire inner surface of the vent path 36 as illustrated in FIG. 7A or that part of the inner surface of the vent path 36 which has the length L1 from the branching position 34*a* as illustrated in FIG. 7B. In this case, the first area 38 may have a larger ink contact angle than at least the inner surface of the branching position 34*a* and the supplying path 34*c*. Alternatively, the first area 38 may be that part of the lower surface of the vent path 36 which has the length L1 from the branching position 34*a* as illustrated in FIG. 7C. In this case, the first area 38 may have a larger ink contact angle than at least the inner surface of the supplying path 34*c*. Moreover, the first area 38 may be formed all over one of the upper and lower surfaces of the vent path 36.

(3) In the second exemplary embodiment, the second area 138 with the smaller ink contact angle than the remaining area is provided on the lower surface of the supplying path 34*b* adjacent to the branching position 34*a*. However, the present invention is not limited to this. That is, the second area may be the entire inner surface of the supplying path 34*b* as illustrated in FIG. 7D or that part of the inner surface of the supplying path 34*b* which has the length L2 from the branching position 34*a* as illustrated in FIG. 7E. Moreover, the second area 138 may be formed all over the lower surface of the supplying path 34*b*. In these cases, the second area 138 may have a smaller ink contact angle than at least the inner surface of the branching position 34*a*.

Figure 7F:
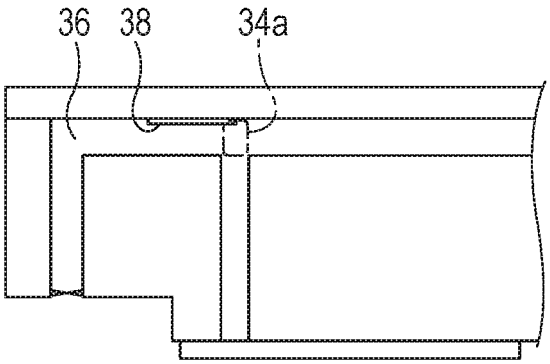

(4) In the first exemplary embodiment, the first area is provided on the upper surface of the vent path 36 adjacent to the branching position 34*a*. However, the first area may include a part of the branching position 34*a* as illustrated in FIG. 7F.

(5) The present invention is not limited only to the recording head (unit) ejecting ink and the printing apparatus with the recording head but is widely applicable as liquid ejection heads and liquid ejection apparatuses for ejecting various liquids.

(6) In the first exemplary embodiment, surface treatment is executed on the first area 38 such that the first area 38 has a larger ink contact angle than the remaining area. However, the present invention is not limited to this. That is, surface treatment may be executed on the remaining area such that the remaining area has a smaller ink contact angle than the first area and that the first area thus has a relatively larger ink contact angle than the remaining area. Furthermore, in the second exemplary embodiment, surface treatment is executed on the second area such that the second area has a smaller ink contact angle than the remaining area. However, the present invention is not limited to this. That is, surface treatment may be executed on the remaining area such that the remaining area has a larger ink contact angle than the second area and that the second area thus has a relatively smaller ink contact angle than the remaining area.

(7) In the above-described exemplary embodiments, the first area 38 has a larger ink contact angle than the remaining area on the inner surface of the channel 30. However, the present invention is not limited to this. That is, the first area 38 may have a larger ink contact angle than at least the inner surface of the branching position 34*a*. Furthermore, in the second exemplary embodiment, the second area 138 has a smaller ink contact angle than the remaining area on the inner surface of the channel 30. However, the present invention is not limited to this. That is, the second area 138 may have a smaller ink contact angle than at least the inner surface of the supplying path 34*c*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-235236, filed Dec. 7, 2017, which is hereby incorporated by reference herein in its entirety.

What is claimed is:

1. A liquid ejection head including a supplying path supplying a liquid to be ejected from an ejection port, the liquid ejection head comprising:

a vent path branching from the supplying path to extend along a horizontal direction, the vent path enabling collection of bubbles mixed into the liquid, wherein an inner surface of the vent path extending along the horizontal direction includes an area formed thereon and having a greater contact angle to the liquid than that of an inner surface of the supplying path.

2. The liquid ejection head according to claim 1, wherein the area is an entire inner surface of the vent path and has a greater contact angle to the liquid than that of an inner surface of a branching position where the vent path branches from the supplying path.

3. The liquid ejection head according to claim 1, wherein the area is positioned on a vertically upper surface of the vent path and has a greater contact angle to the liquid than that of an inner surface of a branching position where the vent path branches from the supplying path.

4. The liquid ejection head according to claim 1, wherein the area is positioned on a vertically lower surface of the vent path and has a greater contact angle to the liquid than that of a part of the inner surface of the supplying path located on a downstream side of a branching position where the vent path branches from the supplying path.

5. The liquid ejection head according to claim 1, wherein the area is adjacent to a branching position where the vent path branches from the supplying path or includes a part of the branching position.

6. The liquid ejection head according to claim 1, wherein the area is subjected to surface treatment.

7. The liquid ejection head according to claim 1, wherein, when the area is represented as a first area, the supplying path includes a second area different from the first area, the second area being formed on a part of the inner surface of the supplying path located on an upstream side of a branching position where the vent path branches from the supplying path, the second area having a smaller contact angle to the liquid than that of a remaining area on the inner surfaces of the supplying path and the vent path.

8. The liquid ejection head according to claim 7, wherein the second area is an entirety of a part of the inner surface of the supplying path located on the upstream side of the branching position and has a smaller contact angle to the liquid than that of a part of the inner surface of the supplying path located on the downstream side of the branching position.

9. The liquid ejection head according to claim 7, wherein the second area is positioned on a part of a vertically lower surface of the supplying path located on the upstream side of the branching position, and has a smaller contact angle to the liquid than that of a part of the inner surface of the supplying path located on the downstream side of the branching position.

10. The liquid ejection head according to claim 7, wherein the second area is subjected to surface treatment.

11. The liquid ejection head according to claim 1, wherein the vent path, a branching position where the vent path branches from the supplying path, and an upstream part of the supplying path with respect to the branching position all include a vertically upper surface on an identical plane.

12. The liquid ejection head according to claim 11, wherein the vent path, the branching position, and the upstream part of the supplying path with respect to the branching position are connected together to extend in a substantially horizontal direction.

13. The liquid ejection head according to claim 1, wherein the vent path and a vertically upper surface of the supplying path are formed of a flexible film member.

14. The liquid ejection head according to claim 1, wherein the supplying path includes a damper unit on an upstream side of a branching position where the vent path branches from the supplying path.

15. A liquid ejection apparatus comprising:

the liquid ejection head according to claim 1;

a storage unit storing the liquid; and a tube unit enabling a liquid stored in the storage unit to be fed to the supplying path of the liquid ejection head.

* * * * *